US009278432B1

(12) United States Patent
Doto

(10) Patent No.: US 9,278,432 B1
(45) Date of Patent: Mar. 8, 2016

(54) SUPPORT SYSTEM FOR A PLURALITY OF RECEIVER BLOCKS

(71) Applicant: Jason William Doto, Sunnyvale, CA (US)

(72) Inventor: Jason William Doto, Sunnyvale, CA (US)

( * ) Notice: Subject to any disclaimer, the term of this patent is extended or adjusted under 35 U.S.C. 154(b) by 76 days.

(21) Appl. No.: 14/326,693

(22) Filed: Jul. 9, 2014

Related U.S. Application Data

(60) Provisional application No. 61/844,064, filed on Jul. 9, 2013.

(51) Int. Cl.
*B25B 11/00* (2006.01)

(52) U.S. Cl.
CPC ..... *B25B 11/00* (2013.01)

(58) Field of Classification Search
CPC ..... B25B 11/00
See application file for complete search history.

(56) References Cited

U.S. PATENT DOCUMENTS

| | | | | | |
|---|---|---|---|---|---|
| 2,444,461 | A * | 7/1948 | Morey | B22D 41/06 | 248/137 |
| 3,247,624 | A * | 4/1966 | Denton | B24B 41/06 | 269/287 |
| 3,325,886 | A * | 6/1967 | Olsen | H01F 27/2455 | 269/118 |
| 3,967,816 | A * | 7/1976 | Ramsperger | B23Q 3/103 | 269/86 |
| 4,164,076 | A * | 8/1979 | Carrigan | B23Q 3/103 | 269/900 |

* cited by examiner

*Primary Examiner* — Lee D Wilson
*Assistant Examiner* — Tyrone V Hall, Jr.
(74) *Attorney, Agent, or Firm* — PLager Schack LLP

(57) ABSTRACT

A support system is configured to prevent a plurality of receiver blocks from moving during gunsmithing activities. The support system includes a plurality of anti-torque plates proximate one another. Each anti-torque plate further includes a parallelepiped, machined with rounded corners to avoid causing an injury. An opening is centered on the parallelepiped. A right receiver accommodation portion is configured to accommodate a right receiver block such that the right receiver block does not move during the gunsmithing activities. A left receiver accommodation portion is configured to accommodate a left receiver block such that the left receiver block does not move during the gunsmithing activities.

7 Claims, 2 Drawing Sheets

SUPPORT SYSTEM FOR A PLURALITY OF RECEIVER BLOCKS

RELATED APPLICATION

This application claims priority to provisional patent application U.S. Ser. No. 61/844,064 filed on Jul. 9, 2013, the entire contents of which is herein incorporated by reference.

BACKGROUND

The embodiments herein relate generally to devises used to restrict motion of an object, particularly in the field of gunsmithing.

Prior to embodiments of the disclosed invention, receiver blocks were held together by hand with the receiver in the middle to be placed in a vise. The assembled receiver blocks and receiver must be held tightly by the vise to keep rotational forces from twisting the blocks and receiver free from the grip of the vise. The additional vise grip pressure can deform and damage the receiver if too much grip force is applied. Embodiments of the present invention solve this problem.

SUMMARY

A support system can be configured to prevent a plurality of receiver blocks from moving during gunsmithing activities. The support system can include a plurality of anti-torque plates proximate one another. Each anti-torque plate can further includes a parallelepiped, machined with rounded corners to avoid causing an injury. An opening can be centered on the parallelepiped. A right receiver accommodation portion can be configured to accommodate a right receiver block such that the right receiver block does not move during the gunsmithing activities. A left receiver accommodation portion can be configured to accommodate a left receiver block such that the left receiver block does not move during the gunsmithing activities.

In some embodiments, the right receiver accommodation portion can further comprise a top right horizontal portion that terminates and turns into a right vertical portion. The right vertical portion can terminate and turn into a lower right horizontal portion. A right vertical portion length can be equal to a right receiver block height. A top right horizontal portion length and a lower right horizontal portion length can be equal to a right receiver block width.

In some embodiments, the left receiver accommodation portion can further comprise a top left horizontal portion that can terminate and turn into a left vertical portion. The left vertical portion can terminate and turn into a lower left horizontal portion. A left vertical portion length can be equal to a left receiver block height. A top left horizontal portion length and a lower left horizontal portion length can be equal to a left receiver block width.

In some embodiments, the opening can further comprise an upper cutout and a lower cutout that can be configured to provide access to a material that can be connecting the right receiver block and the left receiver block. In some embodiments, the upper cutout can further comprise a center left vertical portion that terminates and turns into an upper arcuate portion. The upper arcuate portion can terminate and turn into a center right vertical portion. The lower cutout can further comprise a lower arcuate portion. The left vertical portion, the right vertical portion, the upper cutout and the lower cutout can be adequately offset from any outer edge of the anti-torque plate.

BRIEF DESCRIPTION OF THE FIGURES

The detailed description of some embodiments of the invention made below with reference to the accompanying figures, wherein like numerals represent corresponding parts of the figures.

DETAILED DESCRIPTION OF CERTAIN EMBODIMENTS

Figure 1:
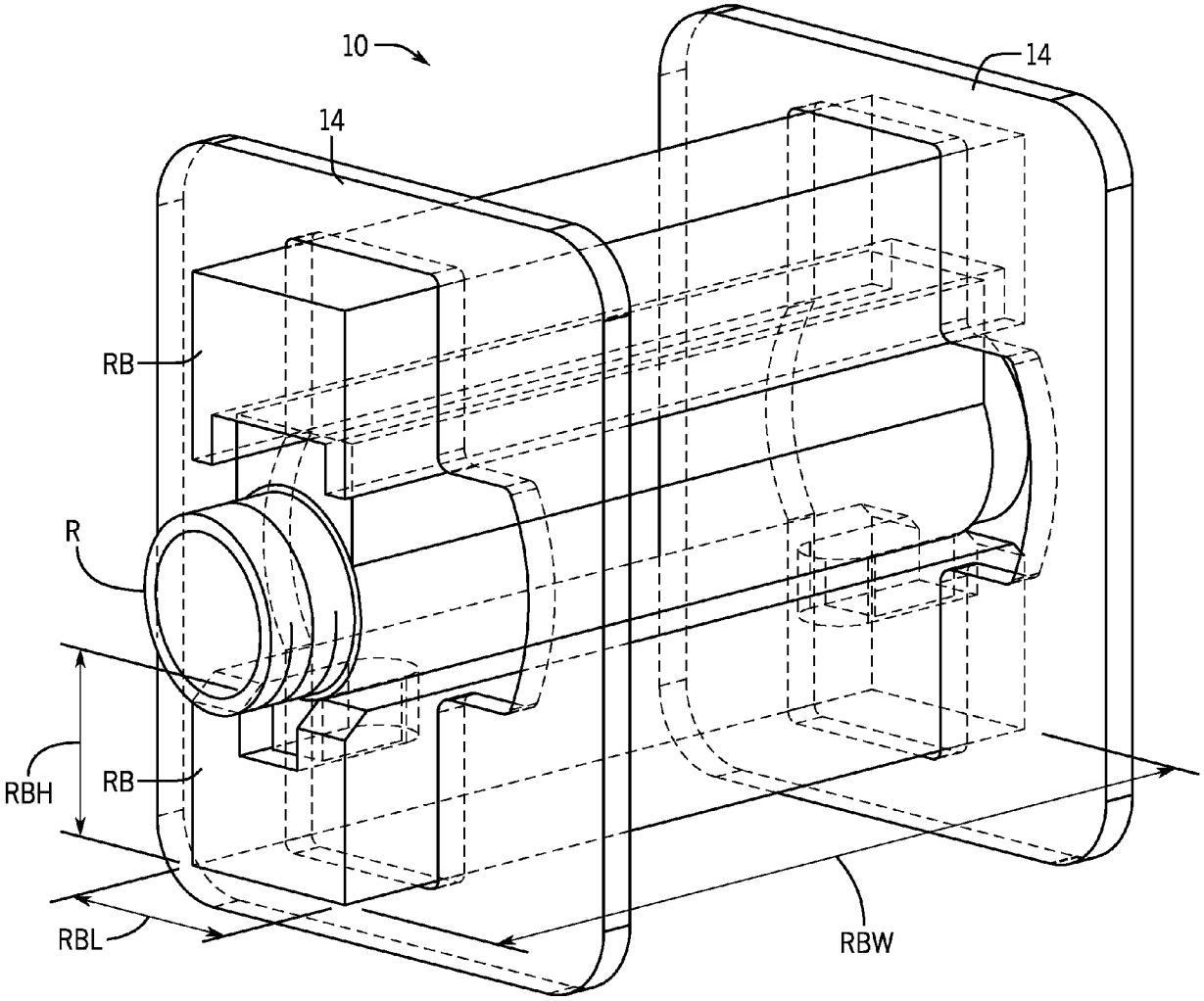
FIG. 1 is a front perspective view of an embodiment of the invention in use.

By way of example, and referring to FIG. 1, one embodiment of the support system 10 is configured to provide support to plurality of receiver blocks RB which in turn support receiver R. Here, the plurality of receiver blocks RB further comprises left receiver block RB and right receiver block RB. The plurality of receiver blocks RB have a known profile and a known cross-section. Left receiver block RB has a left receiver block height RBH, a left receiver block width RBW, and a left receiver block length RBL. Likewise, right receiver block RB has a right receiver block height RBH, a right receiver block width RBW, and a right receiver block length RBL.

Support system 10 comprises a plurality of anti-torque plates 14. The anti-torque plates 14 are shown in more detail below.

Figure 2:
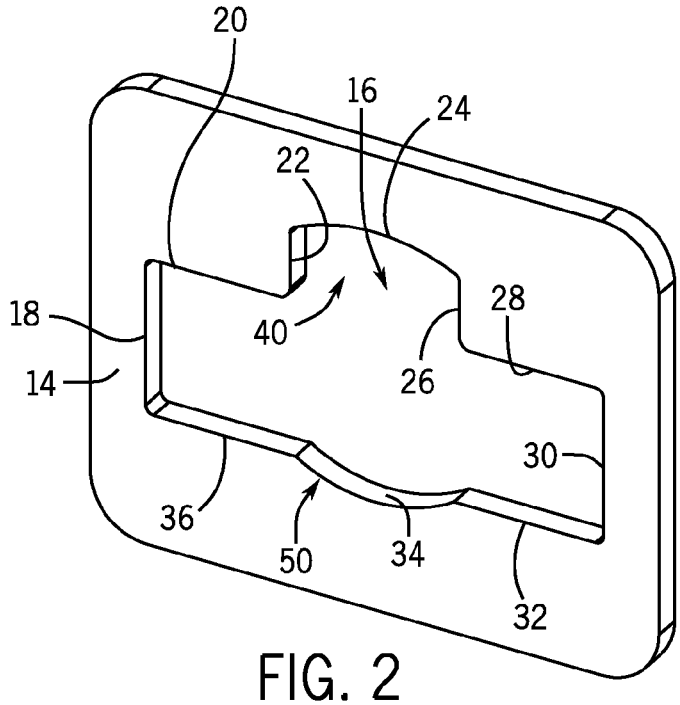
FIG. 2 is a perspective view of an embodiment of the invention.
Figure 3:
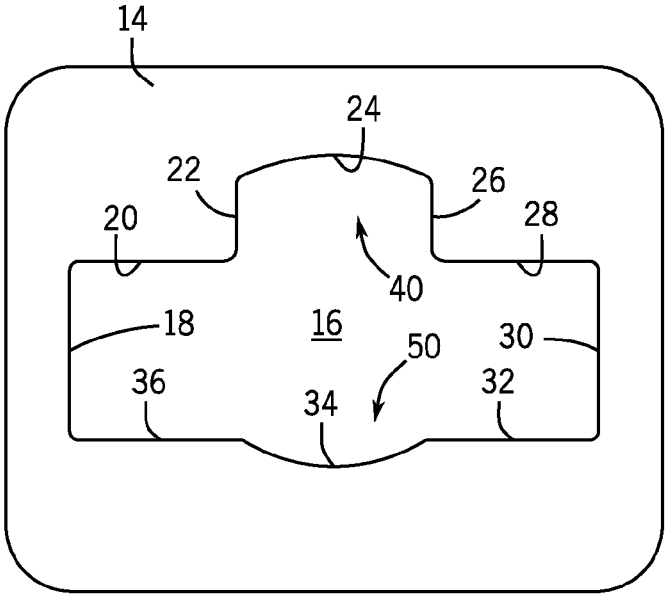
FIG. 3 is a front elevation view.
Figure 4:
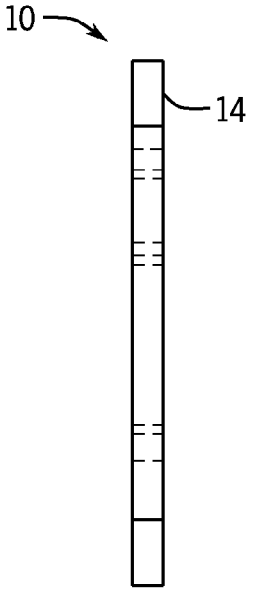
FIG. 4 is a right side elevation view.

FIG. 2, FIG. 3, and FIG. 4 show anti-torque plate 14 in more detail. Anti-torque plate 14 includes a parallelepiped machined with rounded corners to avoid causing injury. Each anti-torque plate 14 further comprises opening 16. Opening 16 further comprises left vertical portion 18. Left vertical portion 18 terminates and turns into top left horizontal portion 20. Top left horizontal portion 20 terminates and turns into upper cutout 40.

Upper cutout 40 further comprises center left vertical portion 22. Center left vertical portion 22 terminates and turns into upper arcuate portion 24. Upper arcuate portion 24 terminates and turns into center right vertical portion 26.

Center right vertical portion 26 terminates and turns into top right horizontal portion 28. Top right horizontal portion 28 terminates and turns into right vertical portion 30.

Right vertical portion 30 terminates and turns into lower right horizontal portion 32. Lower right horizontal portion 32 terminates and turns into lower cutout 50. Lower cutout 50 further comprises lower arcuate portion 34. Lower arcuate portion 34 terminates and turns into lower left horizontal portion 36. Lower left horizontal portion 36 terminates and turns into left vertical portion 18.

In one embodiment, each receiver block RB typically has a known cross-section of about 1.355 inches by 1.253 inches. In this embodiment, left vertical portion 18 has a left vertical portion length and right vertical portion 30 has a right vertical portion length are 1.355 inches. Further, top left horizontal portion 20 has a top left horizontal portion length, top right horizontal portion 28 has a top right horizontal portion length, lower right horizontal portion 32 has a lower right horizontal portion length and lower left horizontal portion 36 has a lower left horizontal portion length which are all 1.253 inches. This forms a left receiver accommodation portion and a right receiver accommodation portion. Precise dimensioning and tolerance of the shape of the receiver block cross section allows force to be distributed throughout the receiver block and substantially reduces both the likelihood of plastic deformation of both receiver block RB and of anti-torque plate 14 as well as minimizing the necessary size of anti-torque plate 14.

Of course, for a receiver block RB of a different dimension, opening 16 could change as well. Though, to prevent plastic deformation, it is advisable to center opening 16 on torque plate 14 as well as ensuring that left vertical portion 18, right vertical portion 30, upper cutout 40 and lower cutout 50 are at lease one half inch from any outer edge of anti-torque plate 14.

To contrast, upper cutout 40 and lower cutout 50 are not so rigidly limited. Rather, upper cutout 40 and lower cutout 50 have their shapes generally determined by the need to access receiver R between left receiver block RB and right receiver block RB. As long as upper cutout 40 and lower cutout 50 are adequately offset (at least one half inch) from any edge on anti-torque plate 14.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A support system, configured to prevent a plurality of receiver blocks from moving during gunsmithing activities; the support system comprising:

a plurality of anti-torque plates proximate one another wherein each anti-torque plate further comprises:

a parallelepiped, machined with rounded corners to avoid causing injury;

an opening, centered on the parallelepiped;

a right receiver accommodation portion, configured to accommodate a right receiver block such that the right receiver block does not move during the gunsmithing activities;

a left receiver accommodation portion, configured to accommodate a left receiver block such that the left receiver block does not move during the gunsmithing activities.

2. The support system of claim 1, wherein the right receiver accommodation portion further comprises a top right horizontal portion that terminates and turns into a right vertical portion; the right vertical portion terminates and turns into a lower right horizontal portion; wherein a right vertical portion length is equal to a right receiver block height; wherein a top right horizontal portion length and a lower right horizontal portion length are equal to a right receiver block width.

3. The support system of claim 2, wherein the left receiver accommodation portion further comprises a top left horizontal portion that terminates and turns into a left vertical portion; the left vertical portion terminates and turns into a lower left horizontal portion; wherein a left vertical portion length is equal to a left receiver block height; wherein a top left horizontal portion length and a lower left horizontal portion length are equal to a left receiver block width.

4. The support system of claim 3, wherein the opening further comprises an upper cutout and a lower cutout configured to provide access to a material that is connecting the right receiver block and the left receiver block.

5. The support system of claim 4, wherein the upper cutout further comprises: a center left vertical portion that terminates and turns into an upper arcuate portion; wherein the upper arcuate portion terminates and turns into a center right vertical portion.

6. The support system of claim 5, wherein the lower cutout further comprises a lower arcuate portion.

7. The support system of claim 6, wherein the left vertical portion, the right vertical portion, the upper cutout and the lower cutout are adequately offset from any outer edge of the anti-torque plate.

* * * * *